US005769505A

United States Patent [19]

Siddle et al.

[11] Patent Number: 5,769,505

[45] **Date of Patent: *Jun. 23, 1998**

[54] CUTTING TOOL HOLDER RETENTION SYSTEM

[75] Inventors: David R. Siddle, Greensburg; Ted R. Massa, Latrobe, both of Pa.

[73] Assignee: Kennametal Inc., Latrobe, Pa.

[ * ] Notice: The term of this patent shall not extend beyond the expiration date of Pat. No. 5,607,206.

[21] Appl. No.: 639,050

[22] Filed: Apr. 24, 1996

Related U.S. Application Data

[63] Continuation-in-part of Ser. No. 510,451, Aug. 2, 1995, Pat. No. 5,607,206.

[51] Int. Cl.[6] ..... E21C 35/193

[52] U.S. Cl. ..... 299/102; 299/106

[58] Field of Search ..... 299/102, 103, 299/106, 108

[56] References Cited

U.S. PATENT DOCUMENTS

| | | | |
|---|---|---|---|
| 2,036,327 | 4/1936 | Fulke | 299/84.1 |
| 2,722,410 | 11/1955 | Brown | 299/103 |
| 2,996,291 | 8/1961 | Krekeler | 299/109 |
| 3,254,922 | 6/1966 | Krekeler | 299/109 |
| 4,084,856 | 4/1978 | Emmerich et al. | 299/104 |
| 4,247,150 | 1/1981 | Wrulich et al. | 299/104 |
| 4,337,980 | 7/1982 | Krekeler | 299/102 |
| 4,542,943 | 9/1985 | Mongtomery, Jr. | 299/102 |
| 4,609,227 | 9/1986 | Wild et al. | 299/103 |
| 5,370,448 | 12/1994 | Sterwerf, Jr. | 299/107 |
| 5,378,050 | 1/1995 | Kammerer et al. | 299/102 |

FOREIGN PATENT DOCUMENTS

| | | | |
|---|---|---|---|
| 484777 | 12/1975 | Australia . | |
| 1470059 | 5/1967 | France . | |
| 2419831 | 11/1975 | Germany . | |
| 3411602 | 10/1985 | Germany . | |
| 320615 | 1/1972 | U.S.S.R. . | |
| 2224045 | 3/1990 | United Kingdom | 299/102 |

OTHER PUBLICATIONS

"Cutter Holder for Planes," Gluckauf, vol. 125, No. 17, 18, Sep. 1989, Essen, DE, p.985, XP002018995.

"Presenting Two New Bit–Holding Systems To Hold Down Your Mining Costs," Kennametal Advertisement B91–158, published 1991.

"Kennametal Mining Products, " Catalog B92–75(15)H2, published 1992.

"A Better Way to Improve Your Coal Production," Kennametal Brochure B92–58(5)E1, Published 1991.

*Primary Examiner*—David J. Bagnell
*Attorney, Agent, or Firm*—John J. Prizzi

[57] ABSTRACT

An excavation cutting tool holder retention system. The cutting tool holder retention system includes a cutting tool holder having a holder engagement surface and a support block having a tool holder bore into which the cutting tool holder is inserted. A pin having a pin engagement surface is movably mounted to the support block. At least one of the holder and pin engagement surfaces defines an inclined surface such that when the pin is moved the pin engagement surface will wedgingly engage the holder engagement surface so as to draw the shank portion of the cutting tool holder into the tool holder bore.

51 Claims, 6 Drawing Sheets

CUTTING TOOL HOLDER RETENTION SYSTEM

CROSS-REFERENCE TO RELATED APPLICATION

This application is a continuation-in-part of, commonly owned U.S. Pat. No. 5,607,206, filed Aug. 2, 1995, entitled "Cutting Tool Holder Retention System."

TECHNICAL FIELD

This invention relates to excavation cutting tools, and more particularly to a retention system for retaining an excavation cutting tool holder in a support block during use.

BACKGROUND ART

Excavation cutting tool assemblies for such applications as continuous mining or road milling typically comprise a cutting tool, sometimes referred to as a cutting bit, rotatably mounted within a support block. The support block in turn is mounted onto a drum or other body, typically by welding, which in turn is driven by a suitable power means. When a number of such support blocks carrying cutting tools are mounted onto a drum, and the drum is driven, the cutting tools will engage and break up the material which is sought to be mined or removed. The general operation of such a mining machine is well known in the art.

Because the support block is exposed, it is subject to wear and abuse and must be cut or torched off the drum and replaced when unusable. In order to prolong the life of the support block, a cutting tool holder, sometimes referred to as a cutting tool sleeve, bit holder, or bit sleeve, is sometimes employed. The cutting tool is rotatably or otherwise releasably mounted within the bit holder which in turn is mounted within the support block via some mechanical connection. This helps to protect the support block from abuse and wear, thus minimizing or eliminating the down time periods otherwise required for drum repair. The use of such bit holders is well known in the art. For example, U.S. Pat. No. 5,067,775 to D'Angelo discloses the use of such a bit holder which is referred to as a sleeve in that patent.

It is well known that such cutting tools and cutting tool holders are subjected to considerable stresses during mining or other operations. Accordingly, it is desirable that the cutting tool holder be mounted to the support block in such a manner as to minimize movement of the cutting bit holder in order to maximize the life of the cutting tool. It is also important that the mounting between the cutting tool holder and the support block be resistant to vibratory loosening which could likewise lead to premature cutting tool wear and failure. Various methods have been proposed or used in the past to mount a cutting tool sleeve within a support block in an attempt to minimize cutting tool holder movement or loosening, while maximizing cutting tool life.

For example, U.S. Pat. No. 3,749,449 to Krekeler discloses a support block having two upstanding members or bifurcations which define therebetween a channel into which fits a tool holder. A pin passes through the support block and the cutting tool holder and releasably secures the tool holder to the support block. The Krekeler patent relies on cooperation between the bottom surface of the cutting tool holder and an upper surface of the support block, at the bottom of the channel, to resist forces tending to pivot the cutting tool holder about the pin. In other words, the Krekeler patent relies upon a close tolerance fit to minimize rotational movement of the cutting tool and cutting tool holder about the pin during use. Otherwise, movement of the cutting tool holder in the support block will cause unnecessary wear to the cutting tool, the cutting tool holder, and the support block.

Alternatively, U.S. Pat. No. 4,650,254 to Wechner discloses the use of two bolts to connect a cutting tool holder to a block. The two bolts pass horizontally through the rear surface of the support block and through the shank portion of the cutting tool holder. Such a connection may be subject to vibratory loosening.

SUMMARY OF THE INVENTION

An object of the present invention is to provide an improved excavation cutting tool holder retention system which allows a cutting tool holder to be securely fastened to a support block in such a manner as to minimize or eliminate any movement or loosening of the cutting holder within the support block.

In carrying out the above objects, and other objects and features of the present invention, an improved excavation cutting tool holder retention system is provided. The improved excavation cutting tool holder retention system comprises a cutting tool holder having a holder engagement surface and a support block having a tool holder bore into which the cutting tool holder is inserted. A pin having a pin engagement surface is movably mounted to the support block such that the pin engagement surface may be moved to engage the holder engagement surface. At least one of the holder and pin engagement surfaces defines an inclined surface such that when the pin engagement surface is moved to engage the holder engagement surface the shank portion of the cutting tool holder will be drawn into the tool holder bore.

In an alternative embodiment, the excavation cutting tool holder retention system comprises a cutting tool holder having a holder engagement surface and a support block having a tool holder bore into which the cutting tool is inserted and a block pin bore intersecting the tool holder bore. The block pin bore defines a block engagement surface which is inclined downwardly relative to the tool holder bore. A pin engages the block engagement surface and the holder engagement surface such that the pin may be moved to draw the cutting tool holder into the tool holder bore.

In a preferred embodiment, the support block has block pin bores which define the block engagement surface and are inclined downwardly. The holder engagement surface of the cutting tool holder is a transverse pin bore. The pin runs through and engages the transverse pin bore of the cutting tool holder. The pin has a pin shaft, a first jam member, and a second jam member, the first and second jam members each having a block engagement portion which movably engages the block pin bores. At least one of the first and second jam members is movable along the pin shaft relative to the other of the first and second jam members such that the block engagement portion of the first and second jam members is moved along the block pin bores and the cutting tool holder is drawn into the tool holder bore.

In a more preferred embodiment, the pin shaft has a threaded portion and one of the first and second jam members has a threaded jam bore such that one of the first and second jam members may threadably engage the pin shaft and be moved relative to the other of the first and second jam members. Furthermore, the first jam member may have a first aligned cylindrical portion and a first angled cylindrical portion and the second jam member may have a second aligned cylindrical portion and a second angled cylindrical portion such that the first and second aligned cylindrical portions engage the transverse pin bore of the cutting tool holder and the first and second angled cylindrical portions define the block engagement portion and engage the block pin bores.

In another more preferred embodiment, the cutting tool holder has a holder slot intersecting the transverse pin bore such that the cutting tool holder may be removed from the tool holder bore of the support block by moving the second jam member relative to the first jam member such that the first and second jam members do not interfere with the transverse pin bore and the cutting tool holder may be withdrawn from the tool holder bore while the first and second jam members still movably engage the block pin bores.

In a preferred embodiment applicable to all preceding embodiments, at least one of the cutting tool holder and tool holder bore is tapered such that the cutting tool holder will be drawn and wedged into the tool holder bore of the support block when the pin engagement surface is moved to engage the holder engagement surface.

In a more preferred embodiment applicable to all preceding embodiments, the tool holder has a holder shoulder and the support block has a seating shoulder region adjacent the tool holder bore. When the cutting tool holder is drawn into the tool holder bore as described, the holder shoulder will abut the seating shoulder region.

The present invention also includes an improved cutting tool holder for use with a support block having a cutting tool holder bore into which the cutting tool holder is inserted and a pin having a pin engagement surface, the pin being movably mounted to the support block. The improved cutting tool holder comprises an outer wear region and a shank portion. The shank portion has a holder engagement surface which engages the pin engagement surface. At least one of the holder and pin engagement surfaces defines an inclined surface such that when the pin engagement surface is moved to engage the holder engagement surface the shank portion will be drawn into the tool holder bore of the support block.

In an alternative embodiment, an improved cutting tool holder is provided for use with a support block and pin, the support block having a tool holder bore into which the cutting tool holder is inserted and block pin bores inclined downwardly, the pin having a pin shaft, a first jam member, and a second jam member movable along the pin shaft relative to the first jam member, the first and second jam members movably engaging the block pin bores. The improved cutting tool holder of this embodiment comprises an outer wear region and a shank portion. The shank portion has a transverse pin bore which is substantially aligned with the block pin bores when the shank portion is inserted into the tool holder bore such that the pin can run between the block pin bores through the transverse pin bore. The first and second jam members engage the block pin bores and the transverse pin bore such that moving the second jam member relative to the first jam member will draw the shank portion into the tool holder bore of the support block.

In a preferred embodiment, the shank portion has a holder slot such that the shank portion may be removed from the tool holder bore of the support block by moving the second jam member relative to the first jam member such that the first and second jam members no longer interfere with the transverse pin bore.

In a more preferred embodiment, the block pin bores and the jam members are configured such that the jam members will not rotate within the block pin bores. This feature provides alignment and orientation properties to properly and easily assemble the pin in the support block. This mating feature may consist of a pin and groove arrangement.

The present invention also includes a pin for use with a support block and a cutting tool holder, the tool holder having a transverse pin bore, the support block having a tool holder bore into which the cutting tool holder is inserted and block pin bores inclined downwardly to and intersecting the transverse pin bore, the pin comprising a pin shaft having a first pitch threaded portion and a second pitch threaded portion, a first jam member having a first aligned cylindrical portion, a first angled cylindrical portion, and a first threaded jam bore, and a second jam member having a second aligned cylindrical portion, a second angled cylindrical portion, and a second threaded jam bore, the first jam member being threaded onto the first pitch threaded portion of the pin shaft and the second jam member being threaded onto the second pitch threaded portion of the pin shaft such that the first and second aligned cylindrical portions may engage the transverse pin bore and the first and second angled cylindrical portions may engage the block pin bores.

The advantages resulting from this invention are numerous. For example, by having one of the holder and pin engagement surfaces defining an inclined surface, the cutting tool holder will be drawn into an especially tight relationship with the tool holder bore. This tight fit is especially secure if one or both of the shank portion or tool holder bore is tapered so that the shank portion of the cutting tool is wedged into the tool holder bore when the components are engaged by utilizing the pin. The security of the fit is also increased if the tool holder has a holder shoulder which abuts a seating shoulder region of the support block when the cutting tool holder is drawn into the tool holder bore. Another advantage of this present invention is that the tool holder bore of the support block may have a configuration so as to completely surround and provide multidirectional support to the cutting tool holder. As a further advantage, when the tool holder is worn, it is easily removed and changed by simply loosening the pin.

Further objects and advantages of this invention will be apparent from the following description, reference being had to the accompanying drawings wherein preferred embodiments of the present invention are clearly shown.

BRIEF DESCRIPTION OF THE DRAWINGS

While various embodiments of the invention are illustrated, the particular embodiments shown should not be construed to limit the claims. It is anticipated that various changes and modifications may be made without departing from the scope of this invention.

BEST MODE FOR CARRYING OUT THE INVENTION

Figure 1:
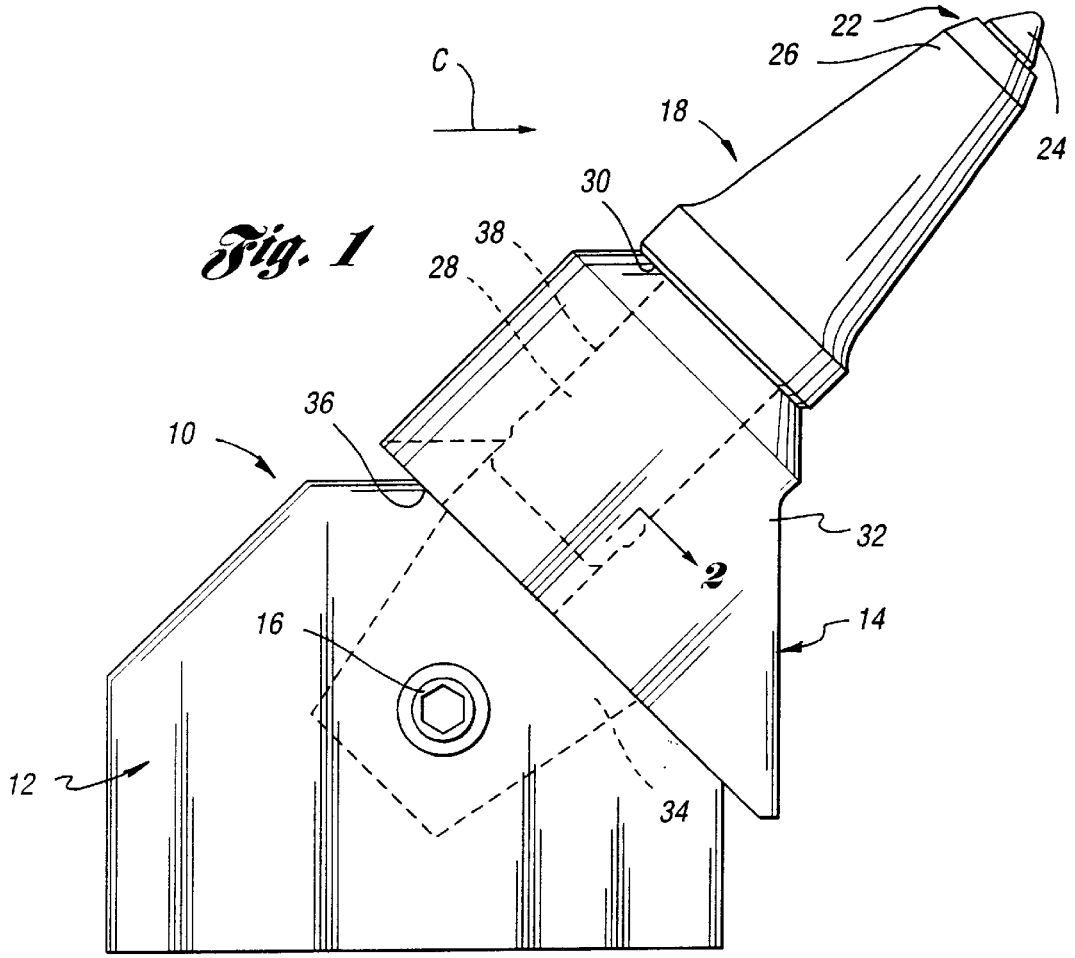
FIG. 1 is a side view of a support block, cutting tool sleeve, and cutting tool showing one embodiment of the invention.
Figure 2:
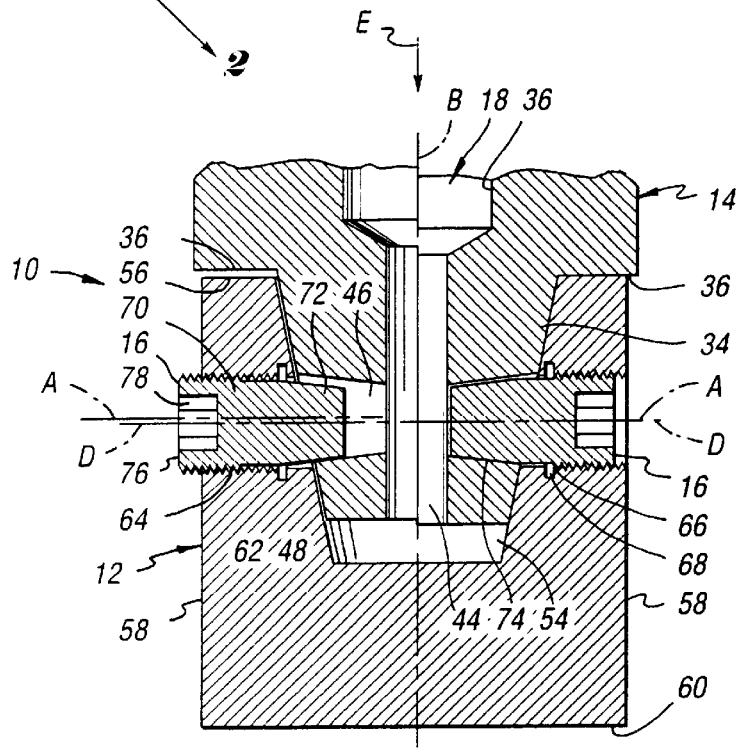
FIG. 2 is a sectional view taken along the plane indicated by line 2—2 in FIG. 1, the left half showing the invention in the loose condition and the right half showing the tightened condition.

One embodiment of the cutting tool holder retention system 10 is shown in FIGS. 1 and 2. The cutting tool retention system 10 includes a support block 12 and a cutting tool holder 14 mated to the support block 12 via pins 16. In the embodiment shown, a cutting tool 18 may be rotatably and releasably mounted within the cutting tool holder 14. However, the scope of this invention would cover cutting tool holder retention systems in which the cutting tool is non-rotatably mounted.

In use, such support blocks 12 can be distributed over and fastened to, such as by welding, the circumference and length of a drum or other body (not shown) according to any desired pattern. The drum or other body may be driven by any conventional and suitable power means to cause the cutting tools 18 to engage and break up material that they are applied to. Such applications are well known in the art, and will not be described further here.

The cutting tool 18 typically has an elongated body. The cutting end 22 of the cutting tool 18 typically comprises a hard cutting insert 24 mounted onto a generally conical outer region 26. This hard cutting insert 24 may be made from cemented tungsten carbide or any other suitable material. The hard cutting insert 24 is generally mounted at the end of the conical outer region 26 where the cutting insert 24 may be brazed or otherwise suitably fastened into place. The cutting tool 18 also includes a tool shank 28 adjoining a shoulder 30 of the conical outer region 26. Because such cutting tools are generally known in the art, they need not be described in further detail here.

Cutting tool holders may have a variety of configurations. The cutting tool holder 14 shown in this embodiment has an outer wear region 32 and a shank portion 34 joined at a holder shoulder 36. The cutting tool holder 14 defines a tool bore 38 in which the cutting tool 18 may be rotatably or otherwise mounted. Such rotatable or non-rotatable mountings are well known in the art, and will not be described in further detail here.

While the shank portion 34 of the cutting tool holder 14 may have a variety of configurations, the shank portion 34 as shown is tapered. The shank portion 34 may be made of solid material, or as shown here, may have a cavity such as a vertical bore 44. The shank portion 34 also has a holder engagement recess which in this embodiment comprises transverse pin bores 46 which are aligned along the axis designated "A" and which intersect the center axis "B" of the shank portion 34. The transverse pin bores 46 are tapered. The holder engagement recess has a holder engagement surface 48 which in the embodiment shown is the lower inclined surface of the tapered transverse pin bores 46.

The support block 12 typically has a tool holder bore 54 surrounded by a seating shoulder region 56. The tool holder bore 54 in this preferred embodiment is tapered so as to match the taper of the shank portion 34 of the cutting tool holder 14. It has been found preferable that the maximum total included taper angle be approximately 16°.

The support block 12 also has a side surface 58 and a base 60 which may be mounted to a drum or other body (not shown) by way of welding or any other suitable method.

The tool holder bore 54, and accordingly the cutting tool holder 14 and the cutting tool 18, is typically pitched in the direction of travel of the cutting tool 18, designated as direction "C" in FIG. 1.

For the purpose of this invention, the support block 12 has block pin bores 62, which are transversely aligned along the axis designated "D" and which intersect the center axis "B" of the tool holder bore 54 in a perpendicular relationship.

In the embodiment shown, the block pin bores 62 have a block threaded portion 64 extending from the side surface 58 to the tool holder bore 54. At the end of the threaded portion, an annular groove 66 may optionally be provided in which an O-ring 68 may be housed.

The pins 16 are movably mounted to the support block 12. In this embodiment of the invention, the pins 16 are movably mounted via a block engagement portion 70 which is threaded. The threaded block engagement portion 70 of the pin 16 is designed to threadably engage the threaded portion 64 of the block pin bores 62 of the support block 12. The pins 16 also have a pin engagement surface 72 which in this embodiment is tapered such as to provide an inclined surface 74 to engage the holder engagement surface 48 of the holder engagement recess 46.

The pins 16 also have a tightening end 76. The tightening end 76 preferably has a configuration, such as a non-circular shape, a protrusion, or a receiving aperture, by which a tool may be used to tighten the pins 16 in the block pin bores 62 as will be set forth. In the embodiment shown, the configuration comprises a hexagonal receiving aperture 78 designed to receive an allen wrench.

While the pins 16 may be made of any suitable material, an alloy steel, such as SAE 4140 or SAE 4340, is preferred.

While two pins 16 are shown as being used in the embodiment depicted, one or more pins may be used. No matter what number of pins are used, the axes of the transverse pin bores 46, and correspondingly the block pin bores 62, need not intersect the tool bore 38 in a perpendicular relationship. Instead, the transverse and block pin bores may be inclined at an angle to the tool bore 38, preferably downwardly from the block surface 58 to the center axis "E" of the tool holder 14 at an angle between 70° and 90°. Furthermore, if two or more pins are used, the axes of the transverse pin bores, and correspondingly the block pin bores, need not be transversely aligned, nor is it required that they intersect.

To use the embodiment of this invention shown in FIGS. 1 and 2, the holder shank portion 34 of the cutting tool holder 14 is inserted into the tool holder bore 54 of the support block 12 such that the transverse pin bores 46 of the cutting tool holder 14 and the block pin bores 62 of the support block 12 are roughly aligned.

The pins 16 are then inserted into the support block pin bores 62. At this point, the transverse pin bores 46 and the block pin bores 62 are still roughly aligned as illustrated by the axes "A" and "D" shown on the left half of FIG. 2. At this point, there will also preferably be a small gap between the holder shoulder 36 and the seating shoulder region 56 of the support block 12, such as shown on the left half of FIG. 2.

The pins 16 are then moved such that the inclined surface 74 of the pin engagement surface 72 will engage the holder engagement surface 48 of the cutting tool holder 14. This movement of the pins 16 is accomplished via the tightening end 76 of the pin 16 which is engaged, with a tool (not shown) or other means, so as to threadably engage the threaded block engagement portion 74 of the pin 16 in the threaded portion 64 of the block pin bore 62. Nylok® manufactured by Nylok Fastener Corporation, or any other suitable material or adhesive, may be employed to help prevent the pin 16 from backing out of the block pin bore 62 during use.

Because at least one, in this case both, of the holder engagement surface 48 and the pin engagement surface 72 defines an inclined surface, the holder shank 34 of the cutting tool holder 14 will be forcibly wedged downward in the direction marked "E" into a tight fitting relationship with the tool holder bore 54 of the support block 12 until the holder shoulder 36 abuts the seating shoulder region 56. At this point, in the embodiment shown, the axis "A" of the transverse pin bores 46 and the axis "D" of the block pin bores 62 will be substantially coincident as shown on the right half of FIG. 2. In order to accomplish this result, it is preferred that the holder engagement surface 48 and pin engagement surface 72 each have a maximum total included angle of approximately 16°. The resulting fit, as shown on the right side of FIG. 2, is especially secure because the holder shank portion 34 and the tool holder bore 54 are matingly tapered.

Accordingly, the resulting tight fit, and the holder shoulder 36 abutting the block seating shoulder region 56, advantageously prevents the cutting tool holder from rotating about the axis "D" of the pins 16. The wedging effect between the holder engagement surface 48 and pin engagement surface 72 in conjunction with the wedging between the holder shank 34 and the tool holder bore 54 will also minimize loosening due to vibration. As a further advantage, when the tool holder is worn, it is easily removed and changed by simply loosening the pins 16.

Figure 3:
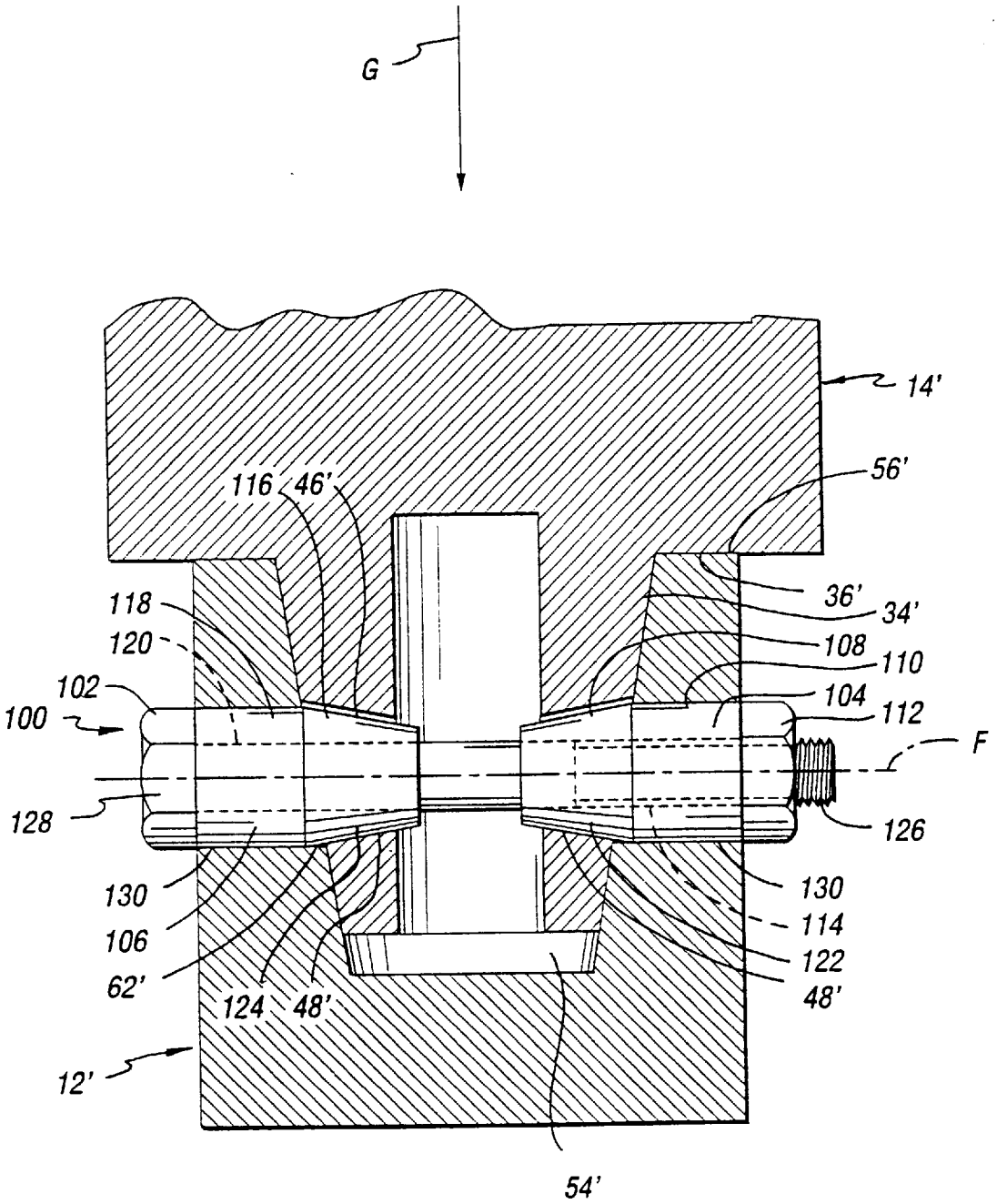
FIG. 3 is a sectional view showing an alternative pin.

An alternative embodiment of this invention is shown in FIG. 3 which is a sectional view similar to FIG. 2. This embodiment is very similar to the cutting tool holder retention system 10 shown in FIGS. 1 and 2. Accordingly, the same components have been referenced using the same reference characters followed by an apostrophe. The main difference is the pin 100 which in this embodiment comprises a screw or threaded bolt 102, a jam member 104, and a cone member 106. The jam member 104 has cone end 108, a cylindrical section 110, a tool end 112, and a threaded throughbore 114. The tool end 112 preferably has a configuration, such as a non-circular shape, a protrusion, or a receiving aperture, by which a tool may be used to retain the jam member 104 in a stationary position while the screw or threaded bolt 102 is being tightened. In the embodiment shown, the tool end 112 has a hexagonal nut configuration designed to be engaged by a wrench.

The cone member 106 has a cone end 116, a cylindrical end 118, and a smooth throughbore 120. The exterior surface of the cone ends 108 and 116 define pin engagement surfaces 122 and 124 respectively which, as a result of the taper of the cone ends 108 and 116, provide inclined surfaces to engage the holder engagement surfaces 48' of the pin bores 46'. It is preferred that the pin engagement surfaces 122 and 124, and the pin engagement surfaces 48', have a maximum total included angle of approximately 16°.

The screw or threaded bolt 102 has a threaded shaft 126 and a head 128 preferably with a configuration, such as a non-circular shape, a protrusion, or a receiving aperture, by which a tool may be used to tighten the screw or threaded bolt 102 in relation to the jam member 104. In the embodiment shown, the configuration of the head 128 is hexagonal such as to be engaged by a suitable wrench.

This alternative embodiment is also different from the embodiment disclosed in FIGS. 1 and 2 in that the block 12' of this embodiment has a block pin bore 130 which is not threaded, but instead is smooth-walled so as to slidably receive the cylindrical section 110 of the jam member 104 and the cylindrical end 118 of the cone member 106.

The use of this embodiment is similar to the use of the embodiment shown in FIGS. 1 and 2. First, the holder shank portion 34' of the cutting tool holder 14' is inserted into the tool holder bore 54' of the support block 12' such that the transverse pin bores 46' and the block pin bores 130 are roughly aligned. At this point, there will preferably be a small gap between the holder shoulder 36' and the seating shoulder region 56' of the support block 12'. The screw or threaded bolt 102, with the cone member 106 already slid onto the shaft 126 is then inserted through the support block pin bores 62' and the transverse pin bores 46'. The jam member 104 is then threadably tightened onto the shaft 126 such that the pin engagement surfaces 122 and 124 will engage the holder engagement surface 48' of the cutting tool holder 14'. Because at least one, in this case both, of the holder engagement surfaces 48' and the pin engagement surfaces 122 and 124 defines an inclined surface, the shank portion 34' of the cutting tool holder 14' will be wedged downward in the direction marked "G" into a tight fitting relationship with the main bore 54' of the support block 12' until the holder shoulder 36' abuts the seating shoulder region 56' as shown in FIG. 3. In order to accomplish this result, it is preferred that the holder engagement surface 48' and pin engagement surfaces 122 and 124 have a maximum total included angle of approximately 16°.

Figure 4:
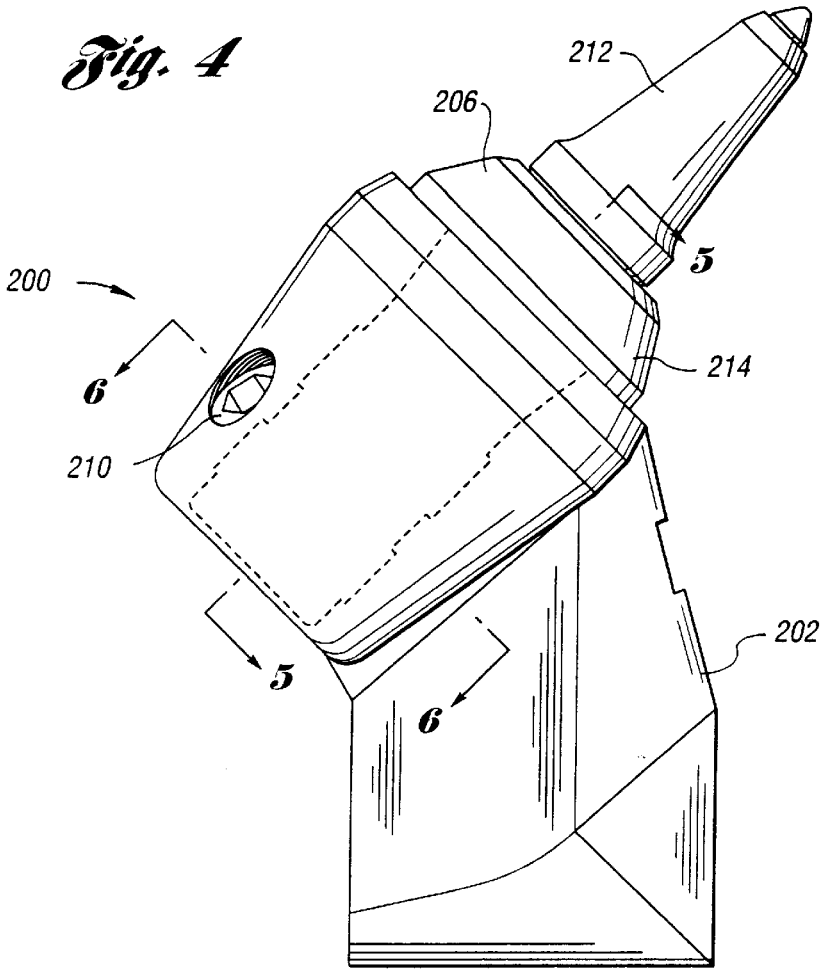
FIG. 4 is a side view of a support block, cutting tool sleeve, and cutting tool showing an alternative embodiment of the invention.
Figure 5:
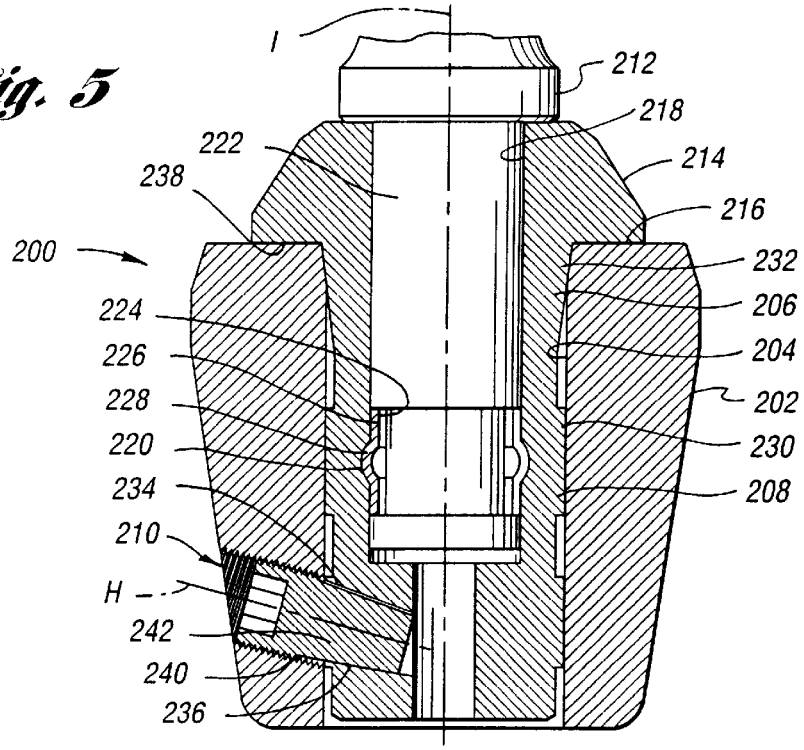
FIG. 5 is a sectional view taken along the plane indicated by line 5—5 in FIG. 4.
Figure 6:
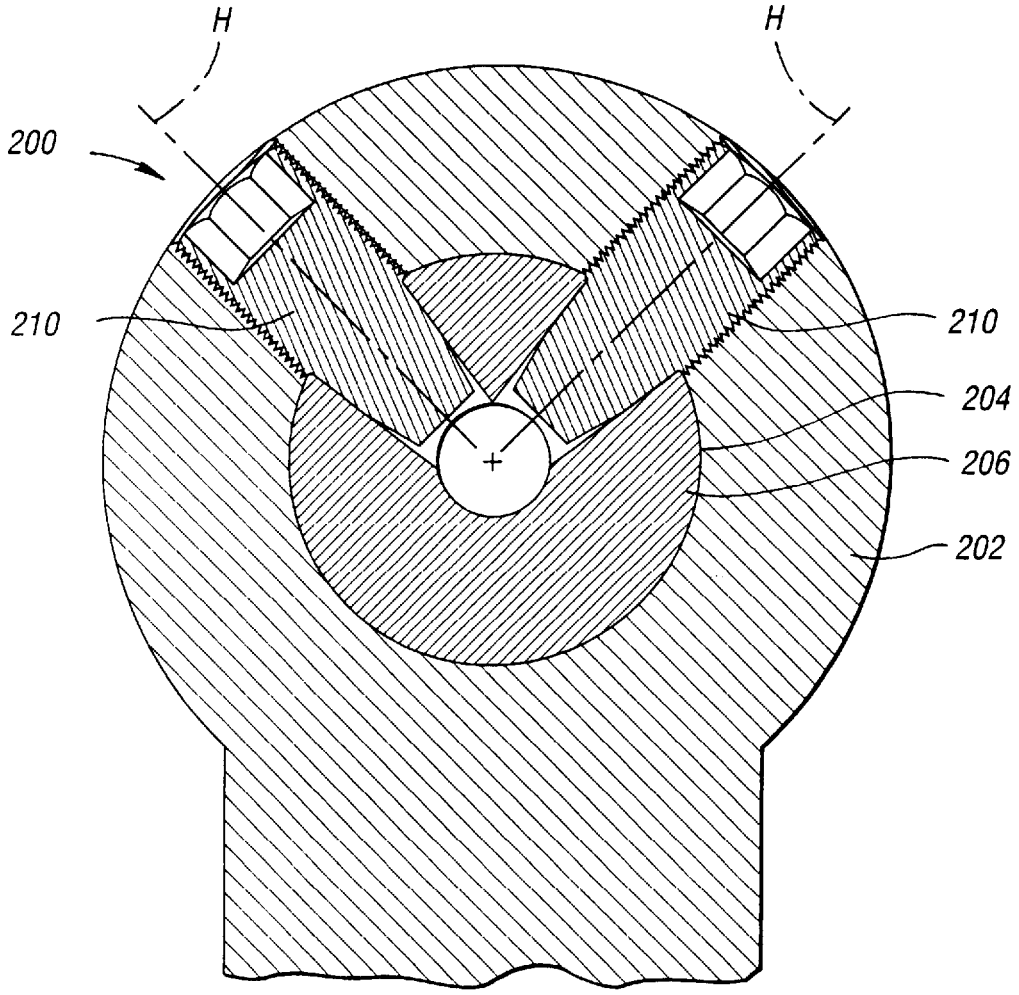
FIG. 6 is a sectional view taken along the plane indicated by line 6—6 in FIG. 4.

Another alternative embodiment of the cutting tool holder retention system 200 is shown in FIGS. 4, 5 and 6. This cutting tool retention 200 includes a support block 202 having a main bore 204, a cutting tool holder 206 having a holder shank portion 208, and pins 210. A cutting tool 212 may be rotatably mounted within the cutting tool holder 206. While the geometrical configuration of the support block 202 and the cutting tool holder 206 has been changed, this embodiment is similar to the embodiments shown in FIGS. 1 and 2 with the exception that the two pins 210 have axes "H" which need not be aligned and which need not be perpendicular to the axis "I" of the shank portion 208 of the cutting tool holder 206. Instead, the axes "H" of the two pins 210 are inclined at an angle as best shown in FIG. 5.

The cutting tool holder 206 in this embodiment is generally symmetrical about the axis "I" and includes an outer wear region 214 and a holder shoulder 216. The cutting tool holder 206 defines a tool bore 218 in which the cutting tool 212 may be rotatably and releasably mounted. As shown in this embodiment, the tool bore 218 defines an annular keeper groove 220. The cutting tool 212 shown in this embodiment has a tool shank 222 defining an annular shank groove 224 adapted for receiving a split keeper ring 226 having projections 228. The tool shank 222 is rotatably mounted within the tool bore 218 via the projections 228 of the split keeper ring 226 which fit within the annular keeper groove 220 of the tool bore 218. Such a mounting is described in U.S. Pat. No. 3,519,309 to Engle et al. and is generally known in the art.

Alternatively, the cutting tool 212 could be rotatably mounted within the tool bore 218 via the mounting disclosed in a co-pending application entitled "Cutting Tool Retention System," filed on Aug. 2, 1995, having U.S.S.N. 08/510,160, and naming Ted Richard Massa as the inventor.

The shank portion 208 of the cutting tool holder 206 of this embodiment comprises a generally cylindrical portion 230 and an upper tapered portion 232 adjacent the shoulder 216. The shank portion 208 also has a holder engagement recess which in this embodiment comprises inclined holder pin bores 234, the axes of which intersect the center axis "I" of the shank portion 208. The holder engagement recess has a holder engagement surface 236 which in the embodiment shown is the lower inclined surface defined by the tapered surface of the inclined holder pin bores 234.

The support block 202 has a seating shoulder region 238. The support block 202 defines inclined block pin bores 240 having a center axis "H" which intersects the center axis "I" of the main bore 204 of the support block 202. The inclined block pin bores 240 in this embodiment are threaded. In order to provide working clearance for the pins 210, and as shown in FIG. 6, the axes "H" of the two block pin bores 240 intersect at an angle, in this example at 90° relative to each other. Of course, the axes of the two block pin bores 240 could intersect at any given angle, and in actuality, need not intersect at all.

The pins 210 have a structure identical to the pins 16 described with regard to the embodiments shown in FIGS. 1 and 2. Accordingly, the pins 210 have a pin engagement surface 242 which are tapered to provide an inclined surface to engage the holder engagement surface 236 of the holder engagement recess, i.e., the inclined holder pin bores 234 shown in this embodiment. Similar to the embodiments shown in FIGS. 1 and 2, the pins 210 are inserted into the inclined block pin bores 240 after being roughly aligned with the inclined holder pin bores 234. At this point, there will preferably be a small gap between the holder shoulder 216 and the seating shoulder region 238 of the support block 202.

The pins 210 are then threadably moved such that the pin engagement surface 242 will engage the holder engagement surface 236 of the cutting tool holder 206. Because at least one, in this case both, of the holder engagement surface 236 and the pin engagement surface 242 defines an inclined surface, the tapered portion 232 of the holder shank portion 208 of the cutting tool holder 206 will be wedged downward into a tight fitting relationship with the main bore 204 of the support block 202 until the holder shoulder 216 abuts the seating shoulder region 238 of the support block 202 as shown in FIG. 5. In order to accomplish this result, it is preferred that the holder engagement surfaces 236 and the pin engagement surfaces 242 have a maximum total included angle of approximately 16°. Not only will this result in a tight fit similar to the embodiments shown in FIGS. 1 and 2, but because the pins 210 are inclined along the axes "H", some of the load carried by the pins 208 will be distributed axially along the pins 208, resulting in a stronger connection overall.

While any angle could be utilized, it is preferred that the pins 208 be set at an angle of approximately 70° to 90° relative to the axis "I" of the main bore 204 of the support block 202. As shown in FIG. 5, it is also preferred that the pins 208 be inclined downwardly from the surface of the support block 202 to the axis "I" of the tool holder 214. While the axes "H" of the pins 210 and the block pin bores 240 preferably intersect at the center axis "I" of the main bore 204, many other arrangements are possible and included in the scope of this invention. Furthermore, while two pins 210 are shown as being used, one or more pins may be used.

Yet another alternative embodiment of the cutting tool holder retention system 300 is shown in FIGS. 7–12. This cutting tool holder retention system 300 includes a support block 302 having a tool holder bore 304 and block pin bores 306, a cutting tool holder 308 having a holder shank portion 310, and a pin 312. A cutting tool 314 may be rotatably mounted within the cutting tool holder 308. While the geometrical configurations of the support block 302, cutting tool holder 308, and cutting tool 314 may vary in an infinite number of ways, this embodiment is identical to the embodiment shown in FIGS. 1 and 2 with the exception that the shank portion 310 of the cutting tool holder 308, the block pin bores 306 of the support block 302 and the pin 312 have been altered. Accordingly, only those components of the holder retention system 300 which have been altered will be described in further detail with regard to this embodiment.

Figure 7:
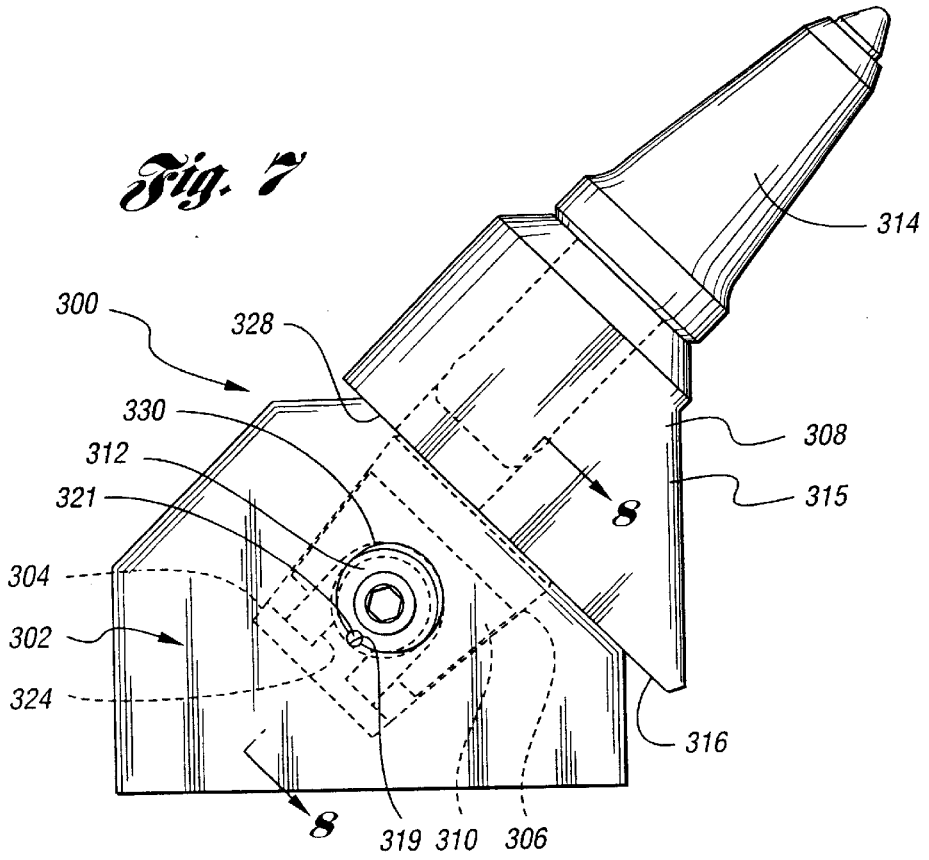
FIG. 7 is a side view of a support block, cutting tool holder, and cutting tool showing another alternative embodiment of the invention.
Figure 8:
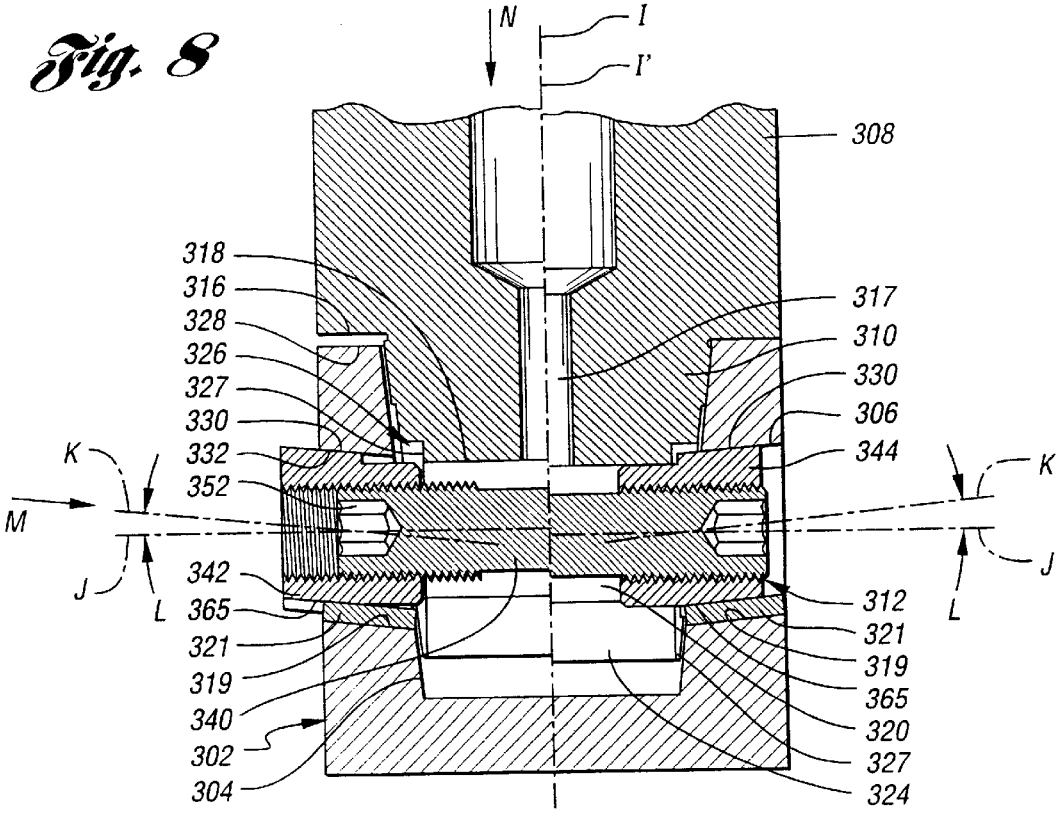
FIG. 8 is a sectional view taken along the plane indicated by line 8—8 in FIG. 7, the left half showing the invention in the loose condition and the right half showing the tightened condition.
Figure 9:
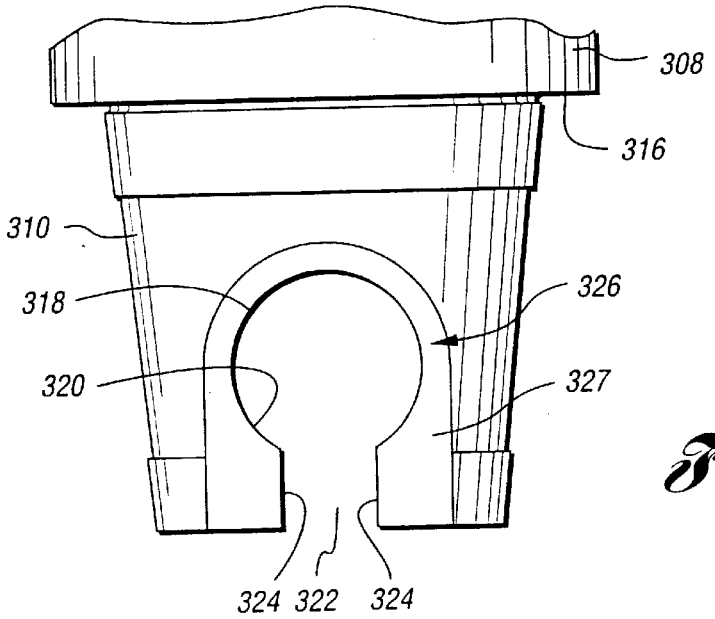
FIG. 9 is a side view of the shank portion of the cutting tool holder.
Figure 10:
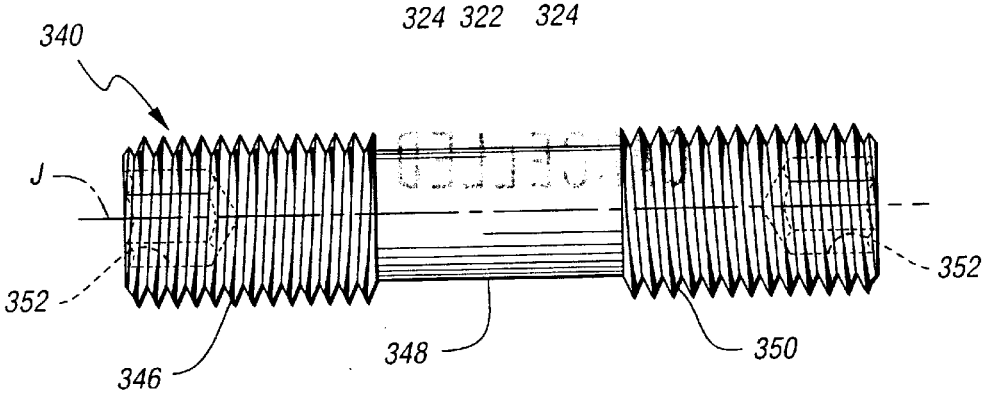
FIG. 10 is a side view of a threaded pin.

The cutting tool holder 308 typically has an outer wear region 315 joining the holder shank portion 310 at a holder shoulder 316. While the holder shank portion 310 of the cutting tool holder 308 may have a variety of configurations, the holder shank portion 310 as shown in FIGS. 7, 8, and 9 is tapered along a center axis "I." The holder shank portion 310 may be made of a solid material, or as shown in FIG. 8, may have a cavity such as a vertical bore 317. The shank portion 310 also has a holder engagement recess which in this embodiment comprises a transverse pin bore 318. The transverse pin bore 318 in this embodiment is cylindrical and aligned along a center axis designated "J" and which preferably intersects the center axis "I" of the shank portion 310. The holder engagement recess has a holder engagement surface 320 which in the embodiment shown, is the surface defined by the transverse pin bore 318, especially the lower surface when locking the tool holder 308 and the upper surface when releasing the tool holder 308.

As best shown in FIGS. 7 and 8, the pin bores 318 also define pin bore grooves 319 along the lower surface of the pin bores 318. The pin bore grooves 319 in this embodiment are semi-cylindrical in shape. Mating pins 321 having a cylindrical configuration reside within the pin bore grooves 319. The mating pins 321 may be press fit into the pin bore grooves 319 in which case the pin bore grooves 319 will have a cross section configuration slightly greater than a half circle or may be held in position using any suitable fastening method such as by tack welding or epoxy adhesives. The mating pins 321 may be made of any suitable material, such as 52100 steel.

As best shown in FIG. 9, the holder shank portion 310 also defines a holder slot 322 defined by two vertical slot sides 324 which intersect the transverse pin bore 318. Additionally, the holder shank 310 defines jam recesses 326 having vertical recess walls 327.

As shown in FIGS. 7 and 8, the tool holder bore 304 of the support block 302 may be partially surrounded but is more typically fully surrounded by a seating shoulder region 328. The tool holder bore 304 of this embodiment has a holder bore center axis "I'" which coincides with the axis "I" of the shank portion 310 of the cutting tool holder 308 when the components are assembled as shown. Furthermore, the support block 302 has block pin bores 330, which are cylindrical and aligned along the block pin bore axes designated "K." As shown in FIG. 8, the block pin bore axes "K" intersect the axis "J" of the transverse pin bore 318 at an angle "L." The block pin bores 330 have a block engagement surface 332, which in the embodiment shown is the surface defined by the block pin bores 330, especially the upper surface when locking the tool holder 308 and the lower surface when releasing the tool holder 308. As shown in FIG. 8, the block engagement surface 332, and in this embodiment the block pin bores 330 having axes "K," are inclined downwardly relative to the tool holder bore 304.

As shown in FIGS. 8, 10, 11, and 12, the pin 312 includes a pin shaft 340, a first jam member 342 and a second jam member 344 which are assembled along the center axis "J." The pin shaft 340 in this embodiment has a first pitch threaded portion 346, an unthreaded portion 348, and a second pitch threaded portion 350. While not shown, the pin shaft need not have an unthreaded portion. Furthermore, while the first pitch threaded portion 346 is shown as being a left hand threaded portion and the second pitch threaded portion is shown as being a right hand threaded portion, that need not be the case. Instead, the pin shaft, if threaded, could have threaded portions which are both left hand or right hand but which differ in thread pitch. While the threads may be made in any suitable manner, as shown in FIG. 4 the first and second pitch threaded portions 346 and 350 may be cold rolled. The pin shaft 340 also has an engagement structure 352 which, in the embodiment shown, constitutes hexagonal recesses centered along the axis "J" of the pin shaft 340.

Figure 11:
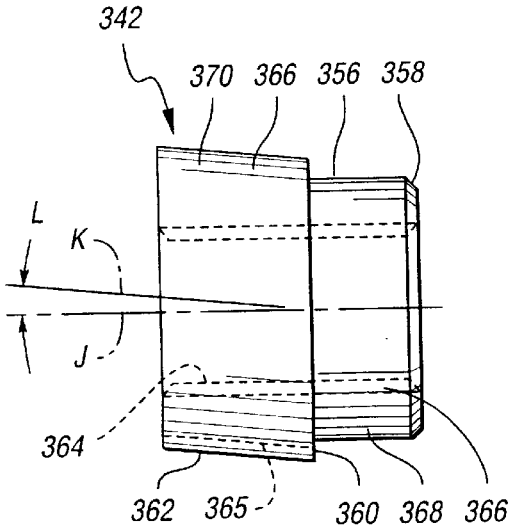
FIG. 11 is a side view of a first jam member.

As shown in FIG. 11, the first jam member 342 has an aligned cylindrical portion 356 aligned along the axis "J," the outer end of which has a chamfer 358, preferably at an angle of 45° to the axis "J". Adjoining the aligned cylindrical portion 356 at a jam shoulder 360 is an angled cylindrical portion 362 having a center axis "K" set at an angle "L" to the axis "J."

The first jam member 342 also defines a threaded jam bore 364 which, in the embodiment shown, constitutes a left hand threaded bore manufactured to threadably engage the first pitch threaded portion 346 of the pin shaft 340.

The first jam member 342 also defines a mating groove 365 along the lower surface of the angled cylindrical portion 362. In this embodiment, the mating groove 365 has a semi-cylindrical configuration designed to mate with the mating pin 321 as will be explained in further detail.

The pin 312 has a pin engagement surface 366. In the embodiment shown, the pin engagement surface 366 has a holder engagement portion 368 and a block engagement portion 370. In this embodiment, the holder engagement portion 368 is the outer surface, especially the lower surface when locking and upper surface when releasing, of the aligned cylindrical portion 356. The block engagement portion 370 is the outer surface, especially the upper surface when locking and the lower surface when releasing, of the angled cylindrical portion 362.

Figure 12:
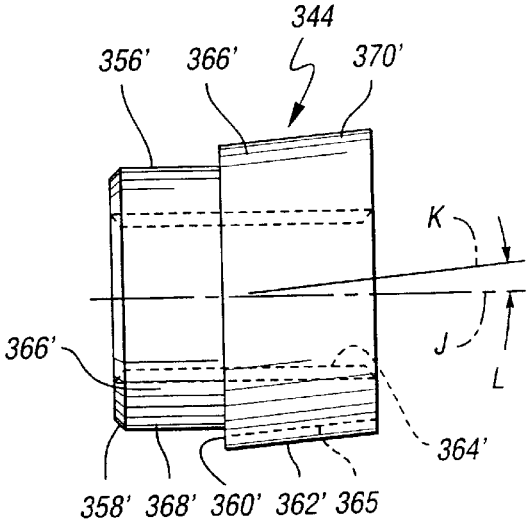
FIG. 12 is a side view of a second jam member.

As shown in FIG. 12, the second jam member 344 is a mirror image duplicate of the first jam member 342. Like the first jam member 342, the second jam member 344 has an aligned cylindrical portion 356', a chamfer 358', a jam shoulder 360', an angled cylindrical portion 362', a threaded jam bore 364' which in the embodiment shown has a right hand thread manufactured to threadably engage the second pitch threaded portion 350 of the pin shaft 340, and a pin engagement surface 366' including a holder engagement portion 368' and a block engagement portion 370'. Also similar to the first jam member 342, the angled cylindrical portion 362' of the second jam member 344 has an axis "K" set at an angle "L" to the center axis "J" of the aligned cylindrical portion 356'.

Like the threaded shaft 340, while the first jam member 342 is shown as having a left hand threaded jam bore 364 and the second jam member 344 is shown as having a right hand threaded jam bore 364, that need not be the case. As long as the threads will engage the first and second pitch portions, 346 and 360, of the threaded shaft 340, the threaded jam bores of the first and second jam members 342 and 344 need only have pitches which differ.

To use the embodiment of this invention shown in FIGS. 7–12, the first or second jam member, 342 or 344, is partially threaded onto the first or second pitch threaded portion respectively, 346 or 350, of the pin shaft 340. The pin shaft 340, together with the one first or second jam member 342 or 344, is then inserted through the block pin bores 306 such that the mating groove 365 or 365' of the first or second jam member, 342 or 344, is aligned roughly with the mating pin 321 of one of the block pin bores 306.

The other of the second or first jam member, 344 or 342, is then threaded onto the other of the second or first pitch threaded portion, 350 or 346, of the pin shaft 340 until the mating groove 365' or 365 of the second or first jam member, 344 or 342, is roughly aligned with the mating pin 321 of the other one of the block pin bores 306.

An appropriate tool may then be used to engage the engagement structure 352 of the pin shaft 340 and rotate the pin shaft 340 appropriately such that the first and second jam members, 342 and 344, will be drawn towards each other. At the same time, the first and second jam members 342 and 344 must be maintained in position until the mating grooves 365 and 365' engage the mating pins 321. As shown on the left half of FIG. 8, the pin shaft 340 may be rotated until the angled cylindrical portion 362 and 362' of the first and second jam members, 342 and 344, reside partially within the block pin bores 306.

The holder shank portion 310 of the cutting tool holder 308 may then be inserted into the tool holder bore 304 of the support block 302 such that the pin shaft 340 will slide through the holder slot 322 into the transverse pin bore 318 of the cutting tool holder shank portion 310.

At this point, and as shown on the left half of FIG. 8, the holder shank portion 310 of the cutting tool holder 308 will be loosely fitted within the tool holder bore 304 of the support block 302.

An appropriate tool may then again be used to engage the engagement structure 352 of the pin shaft 340 and rotate the pin shaft 340 appropriately such that the first and second jam members, 342 and 344, will be drawn towards each other. As the first and second jam members, 342 and 344, are drawn towards each other, the aligned cylindrical portions 356 and 356' of the jam members, 342 and 344, will be forced into the transverse pin bore 318 aided by the chamfers 358 and 358' on the ends of the jam members. At the same time, the rotation of the pin shaft 340 will cause the block engagement portions 370 and 370' of the pin engagement surfaces 366 and 366' of the angled cylindrical portions 362 and 362' to travel along and engage the block engagement surfaces 332 of the block pin bores 330 such that the jam members will move in the direction marked "M," as shown in FIG. 8. At the same time, the holder engagement portions 368 and 368' of the pin engagement surfaces 366 and 366' of the jam members, 342 and 344, will engage the holder engagement surface 320 of the cutting tool holder shank portion 310 thereby forcibly wedging the cutting tool holder shank portion 310 of the cutting tool holder 308 in the direction marked "N," as shown in FIG. 8, into a tight fitting relationship with the tool holder bore 304 of the support block 302 until the holder shoulder 316 abuts the seating shoulder region 328 as shown on the right half of FIG. 8. As shown on the right half of FIG. 8, the jam shoulder 360 may then protrude into the jam recess 326 of the cutting tool holder shank portion 310.

The cutting tool holder retention system 300 shown in FIGS. 7–12 should work satisfactorily when the transverse pin bore 318 of the cutting tool holder shank portion 310 has a diameter of 1.000" to 1.001", the holder slot 322 has a dimension of 0.627" to 0.630" between the vertical recess walls 324, the block pin bores 306 have a diameter of 1.124" to 1.125" set at an angle "L" between 5°±10' and 8°±10', the aligned cylindrical portion 356 of the jam members 342 and 344 has a diameter of 0.998" to 0.999", the angled cylindrical portion 362 of the jam members has a diameter of 1.122" to 1.123" and is set at an angle between 5°±10' - and 8°±10' so as to match the angle of the block pin bores 306, and the threaded jam bore 364 constitutes a 37/64" through hole, tapped to 5/8" 24 thread, right or left handed as required, and the unthreaded portion 348 of the pin shaft 340 has a diameter of 0.54' while the first and second pitch threaded portions 346 and 350 are 5/8" - 24 thread, left or right handed as required. All of the components may be made from any appropriate grade of steel, such as grade 4140 steel, 38–43 HRC.

Nylok® manufactured by Nylok Fastener Corporation, or any other suitable material or adhesive, may be employed to help prevent the pin shaft 340 from rotating during use and allowing the first and second jam members, 342 and 344, from loosening.

When it is desired to change the cutting tool holder 308, the pin shaft 340 is simply rotated in the opposite direction via the engagement structure 352 until the cutting tool holder shank portion 310 can be removed from the tool holder bore 304 and the pin shaft 340 via the holder slot 322. As shown on the left half of FIG. 8, the first and second jam members, 342 and 344, need not be removed from the pin shaft 340, and the mating grooves 365 and 365' need not be disengaged from the mating pins 321, for the cutting tool holder 308 to be removed.

Advantages of this embodiment are that the matching cylindrical surfaces of the transverse pin bore 318 and the aligned cylindrical portions 356 and 356' of the jam members, 342 and 344, together with the matching cylindrical surfaces of the block pin bores 330, and the corresponding angled cylindrical portions 362 and 362' of the jam members, will provide a better contacting relationship between the engagement surfaces, thereby lowering contact stresses. Furthermore, because the pin shaft 340 moves in the direction "M" as the cutting tool holder retention system 300 is tightened, a locking action is provided to restrain the system and help prevent undesired loosening. Similarly, during unlocking, the pin translates forward in a direction reverse of "N," providing a "bump off" motion to the cutting tool holder 308 for easier disengagement. Yet another advantage, is that the holder slot 322 in the cutting tool holder shank portion 310 allows the cutting tool holder 308 to be changed without the removal of any pins or screws from the support block 302. Lastly, another advantage of this embodiment is that by not using conical components, the need for special tooling is eliminated and manufacturing costs are reduced.

All patents and patent applications cited herein are hereby incorporated by reference in their entirety.

While particular embodiments of the invention have been illustrated and described, it will be obvious to those skilled in the art that various changes and modifications may be made without departing from this invention. It is intended that the following claims cover all such modifications and all equivalents that fall within the spirit of this invention.

What is claimed is:

1. An excavation cutting tool holder retention system comprising:

a cutting tool holder having a holder engagement surface;

a support block having a tool holder bore into which the cutting tool holder is inserted; and a pin having a pin engagement surface, the pin being threadably mounted to the support block, at least one of the holder and pin engagement surfaces defining an inclined surface such that when the pin is moved the pin engagement surface will wedgingly engage the holder engagement surface so as to draw the cutting tool holder into the tool holder bore.

2. The excavation cutting tool holder retention system of claim 1 wherein the cutting tool holder has a shank portion which is inserted into the tool holder bore, and at least one of the shank portion and tool holder bore is tapered such that the shank portion of the cutting tool holder will be wedged into the tool holder bore as the cutting tool holder is drawn into the tool holder bore.

3. The excavation cutting tool holder retention system of claim 1 wherein at least one of the holder and pin engagement surfaces has a generally conical shape.

4. The excavation cutting tool holder retention system of claim 1 wherein the support block has a seating shoulder region and the cutting tool holder has a holder shoulder such that the seating shoulder region will abut the holder shoulder when the cutting tool holder is drawn into the tool holder bore.

5. The excavation cutting tool holder retention system of claim 1 wherein at least one of the cutting tool holder and tool holder bore is tapered such that the cutting tool holder will be wedged into the tool holder bore of the support block when the pin engagement surface is moved to wedgingly engage the holder engagement surface so as to draw the cutting tool holder into the tool holder bore.

6. The excavation cutting tool holder retention system of claim 5 wherein the support block has a seating shoulder region and the cutting tool holder has a holder shoulder such that the seating shoulder region will abut the holder shoulder when the cutting tool holder is drawn into the tool holder bore.

7. The excavation cutting tool holder retention system of claim 1 wherein the cutting tool holder has a shank portion having the holder engagement surface such that the shank portion of the cutting tool holder will be drawn into the tool holder bore.

8. The excavation cutting tool holder retention system of claim 7 wherein at least one of the shank portion and the tool holder bore is tapered such that the shank portion of the cutting tool holder will be wedged into the tool holder bore of the support block when the pin engagement surface is moved to wedgingly engage the holder engagement surface so as to draw the shank portion of the cutting tool holder into the tool holder bore.

9. The excavation cutting tool holder retention system of claim 8 wherein the support block has a seating shoulder region and the cutting tool holder has a holder shoulder such that the seating shoulder region will abut the holder shoulder when the shank portion of the cutting tool holder is drawn into the tool holder bore.

10. An excavation cutting tool holder retention system comprising:

a cutting tool holder having a shank portion, the shank portion having a holder engagement recess, the holder engagement recess having a holder engagement surface;

a support block having a threaded block pin bore and a tool holder bore into which the shank portion of the cutting tool holder is inserted; and a pin having a threaded engagement portion and a pin engagement surface, the threaded engagement portion of the pin threadably engaging the threaded block pin bore, at least one of the holder and pin engagement surfaces defining an inclined surface, and at least one of the shank portion and tool holder bore being tapered, such that when the pin is moved the pin engagement surface will wedgingly engage the holder engagement surface and the shank portion of the cutting tool holder will be drawn and wedged into the tool holder bore.

11. The excavation cutting tool holder retention system of claim 10 wherein the support block has a seating shoulder region and the cutting tool holder has a holder shoulder such that the seating shoulder region will abut the holder shoulder when the shank portion of the cutting tool holder is drawn into the tool holder bore.

12. The excavation cutting tool holder retention system of claim 10 wherein at least one of the holder engagement recess and pin engagement surface has a generally conical shape.

13. The excavation cutting tool holder retention system of claim 10 wherein the shank portion of the cutting tool holder has a shank axis and the threaded block pin bore of the support block has a pin bore axis and the shank axis intersects the pin bore axis in a perpendicular relationship.

14. The excavation cutting tool holder retention system of claim 10 wherein the shank portion of the cutting tool holder has a shank axis and the threaded block pin bore of the support block has a pin bore axis and the shank axis intersects the pin bore axis at an acute angle.

15. The excavation cutting tool holder retention system of claim 10 wherein the tool holder bore of the support block has a tool holder bore axis, a first pin has a first pin axis and a second pin has a second pin axis, and the first pin axis and the second pin axis are aligned and intersect the tool holder bore axis.

16. The excavation cutting tool holder retention system of claim 10 wherein the tool holder bore of the support block has a tool holder bore axis, a first pin has a first pin axis and a second pin has a second pin axis, the first pin axis and the second pin axis intersect at an acute angle, and both the first pin axis and the second pin axis intersect the tool holder bore axis.

17. An excavation cutting tool holder for use with a support block having a tool holder bore into which the cutting tool holder is inserted and a pin having a pin engagement surface, the pin being movably mounted to the support block, the cutting tool holder comprising:

an outer wear region and a shank portion, the shank portion having a pin bore defining a holder engagement surface, at least one of the holder and pin engagement surfaces defining an inclined surface such that when the pin is moved the pin engagement surface will wedgingly engage the holder engagement surface, so as to draw the shank portion into the tool holder bore of the support block.

18. The excavation cutting tool holder of claim 17 wherein the holder engagement surface defines an inclined surface.

19. The excavation cutting tool holder of claim 18 wherein the holder engagement surface has a generally conical shape.

20. The excavation cutting tool holder of claim 18 wherein the outer wear region defines a holder shoulder that abuts the support block when the shank portion is drawn into the tool holder bore of the support block.

21. The excavation cutting tool holder of claim 18 wherein the shank portion is tapered such that the shank portion will be wedged into the tool holder bore of the support block when the pin engagement surface is moved to wedgingly engage the holder engagement surface so as to draw the shank portion into the tool holder bore of the support block.

22. The excavation cutting tool holder of claim 21 wherein the outer wear region defines a holder shoulder that abuts the support block when the shank portion is drawn into the tool holder bore of the support block.

23. An excavation cutting tool holder retention system comprising:

a cutting tool holder having a holder engagement surface;

a support block having a tool holder bore into which the cutting tool holder is inserted and a block pin bore intersecting the tool holder bore, the block pin bore defining a block engagement surface which is inclined downwardly relative to the tool holder bore; and a pin having an aligned portion which engages the holder engagement surface and an angled portion which engages the block engagement surface such that the pin may be moved to draw the cutting tool holder into the tool holder bore.

24. The excavation cutting tool holder retention system of claim 23 wherein the holder engagement surface is defined by a transverse pin bore.

25. The excavation cutting tool holder retention system of claim 24 wherein the block pin bore is cylindrical and the transverse pin bore is cylindrical.

26. The excavation cutting tool holder retention system of claim 23 wherein one of the block pin bore and angled portion has a male mating feature and the other of the block pin bore and angled portion has a female mating feature such that the angled portion will not rotate within the block pin bore.

27. The excavation cutting tool holder retention system of claim 23 wherein the cutting tool holder has a shank portion and at least one of the shank portion and tool holder bore is tapered such that the shank portion of the cutting tool holder will be wedged into the tool holder bore of the support block when the pin is moved to draw the cutting tool holder into the tool holder bore.

28. The excavation cutting tool holder retention system of claim 27 wherein the support block has a seating shoulder region and the cutting tool holder has a holder shoulder such that the seating shoulder region will abut the holder shoulder when the pin is moved to draw the cutting tool holder into the tool holder bore.

29. An excavation cutting tool holder retention system comprising:

a cutting tool holder having a transverse pin bore;

a support block having a tool holder bore into which the cutting tool holder is inserted and block pin bores intersecting the tool holder bore, the block pin bores being inclined downwardly relative to the tool holder bore; and a pin running through and engaging the transverse pin bore of the cutting tool holder, the pin having a pin shaft, a first jam member, and a second jam member, the first and second jam members each having a block engagement portion which movably engages the block pin bores, at least one of the first and second jam members being movable along the pin shaft relative to the other of the first and second jam members such that the block engagement portion of the first and second jam members is moved along the block pin bores and the cutting tool holder is drawn into the tool holder bore.

30. The excavation cutting tool holder retention system of claim 29 wherein the pin shaft has a threaded portion and one of the first and second jam members has a threaded jam bore such that one of the first and second jam members may threadably engage the pin shaft and be movable relative to the other of the first and second jam members by rotating the pin shaft.

31. The excavation cutting tool holder retention system of claim 29 wherein the pin shaft has a first pitch threaded portion and a second pitch threaded portion, the first jam member has a first threaded jam bore such that the first jam member threadably engages the first pitch threaded portion of the pin shaft and the second jam member has a second threaded jam bore such that the second jam member threadably engages the second pitch threaded portion of the pin shaft such that the first and second jam members may be movable along the pin shaft relative to the other of the first and second jam members by rotating the pin shaft.

32. The excavation cutting tool holder retention system of claim 29 wherein the block pin bores and the first and second jam members are configured such that the first and second jam members will not rotate within the block pin bores.

33. The excavation cutting tool holder retention system of claim 29 wherein the block pin bores and the transverse pin bore are cylindrical.

34. The excavation cutting tool holder retention system of claim 33 wherein the first jam member has a first aligned cylindrical portion and a first angled cylindrical portion and the second jam member has a second aligned cylindrical portion and a second angled cylindrical portion, the first and second aligned cylindrical portions engaging the transverse pin bore of the cutting tool holder and the first and second angled cylindrical portions defining the block engagement portion and engaging the block pin bores.

35. The excavation cutting tool holder of claim 34 wherein one of the block pin bores and the first and second angled cylindrical portions define a male mating feature and the other of the block pin bores and the first and second angled cylindrical portions define a female mating feature such that the first and second angled cylindrical portions will not rotate within the block pin bores.

36. The excavation cutting tool holder of claim 35 wherein the male mating feature is a semi-cylindrical projection and the female mating feature is a semi-cylindrical groove.

37. The excavation cutting tool holder retention system of claim 34 wherein the cutting tool holder has a holder slot intersecting the transverse pin bore such that the cutting tool holder may be removed from the tool holder bore of the support block by moving the second jam member relative to the first jam member such that the first aligned cylindrical portion and the second aligned cylindrical portion no longer interfere with the transverse pin bore and the cutting tool holder may be withdrawn from the tool holder bore while the first and second angled cylindrical portions still engage the block pin bores.

38. The excavation cutting tool holder retention system of claim 29 wherein the cutting tool holder has a holder slot intersecting the transverse pin bore such that the cutting tool holder may be removed from the tool holder bore of the support block by moving the second jam member relative to the first jam member such that the first and second jam members do not interfere with the transverse pin bore and the cutting tool holder may be withdrawn from the tool holder bore while the first and second jam members will still movably engage the block pin bores.

39. The excavation cutting tool holder retention system of claim 29 wherein the cutting tool holder has a shank portion and at least one of the shank portion and the tool holder bore is tapered such that the shank portion of the cutting tool holder will be wedged into the tool holder bore of the support block when the cutting tool holder is drawn into the tool holder bore.

40. The excavation cutting tool holder retention system of claim 39 wherein the support block has a seating shoulder region and the cutting tool holder has a holder shoulder such that the seating shoulder region will abut the holder shoulder when the cutting tool holder is drawn into the tool holder bore.

41. A cutting tool holder for use with a support block and pin, the support block having a tool holder bore into which the cutting tool holder is inserted and block pin bores inclined downwardly, the pin having a pin shaft, a first jam member, and a second jam member movable along the pin shaft relative to the first jam member, the first and second jam members movably engaging the block pin bores, the cutting tool holder comprising:

an outer wear region and a shank portion, the shank portion having a transverse pin bore which is substantially aligned with the block pin bores when the shank portion is inserted into the tool holder bore such that the pin can run between the block pin bores through the transverse pin bore, the first and second jam members engaging the block pin bores and the transverse pin bore such that moving the second jam member relative to the first jam member will draw the shank portion into the tool holder bore of the support block.

42. The cutting tool holder of claim 41 wherein the shank portion has a holder slot such that the shank portion may be removed from the tool holder bore of the support block by moving the second jam member relative to the first jam member such that the first and second jam members no longer interfere with the transverse pin bore and the shank portion may be withdrawn from the tool holder bore such that the first and second jam members still engage the block pin bores.

43. A pin for use with a support block and a cutting tool holder, the tool holder having a transverse pin bore, the support block having a tool holder bore into which the cutting tool holder is inserted and block pin bores inclined downwardly to and intersecting the transverse pin bore, the pin comprising:

a pin shaft having a first pitch threaded portion and a second pitch threaded portion, a first jam member having a first aligned cylindrical portion, a first angled cylindrical portion, and a first threaded jam bore, a second jam member having a second aligned cylindrical portion, a second angled cylindrical portion, and a second threaded jam bore, the first threaded jam bore threadably engaging the first pitch threaded portion of the pin shaft and the second threaded jam bore threadably engaging the second pitch threaded portion of the pin shaft such that the first and second aligned cylindrical portions may engage the transverse pin bore and the first and second angled cylindrical portions may engage the block pin bores such that rotating the pin shaft will move the first jam member relative to the second jam member and draw the cutting tool holder into the tool holder bore of the support block.

44. The pin of claim 43 wherein the first and second angled cylindrical portions have a mating groove.

45. An excavation cutting tool holder retention system comprising:

a cutting tool holder having a transverse pin bore;

a support block having a tool holder bore into which the cutting tool holder is inserted and a block pin bore intersecting the tool holder bore so that it may be approximately aligned with the transverse pin bore of the cutting tool holder when the cutting tool holder is inserted into the tool holder bore; and a pin having opposing pin engagement surfaces which may be moved relative to each other, at least one of the transverse pin bore and pin engagement surfaces defining an inclined surface such that when the opposing pin engagement surfaces are contracted relative to each other, one or more of the pin engagement surfaces will engage the transverse pin bore so as to draw the cutting tool holder into the tool holder bore.

46. The excavation cutting tool holder retention system of claim 45 wherein the pin is a threaded member having opposing members threadably engaging the threaded member, each of the opposing members having a pin engagement surface.

47. The excavation cutting tool holder retention system of claim 45 wherein at least one of the transverse pin bore and pin engagement surfaces has a generally conical shape.

48. The excavation cutting tool holder retention system of claim 45 wherein the support block has a seating shoulder region and the cutting tool holder has a holder shoulder such that the seating shoulder region will abut the holder shoulder when the cutting tool holder is drawn into the cutting tool holder bore.

49. The excavation cutting tool holder retention system of claim 45 wherein at least one of the cutting tool holders and the tool holder bore is tapered such that the cutting tool holder will be wedged into the tool holder bore of the support block when the pin engagement surfaces engage the holder engagement surface so as to draw the cutting tool holder into the tool holder bore.

50. The excavation cutting tool holder retention system of claim 45 wherein one or more of the pin engagement surfaces wedgingly engage the transverse pin bore so as to draw the cutting tool holder into the tool holder bore.

51. The excavation cutting tool holder retention system of claim 50 wherein the pin is a threaded member having opposing members threadably engaging the threaded member, each of the opposing members having a pin engagement surface and at least one of the pin engagement surfaces having a generally conical shape.

* * * * *